US006324986B1

(12) United States Patent
Rossmann et al.

(10) Patent No.: US 6,324,986 B1
(45) Date of Patent: Dec. 4, 2001

(54) CARTRIDGE-CASE BASE FOR A SUB-CALIBER PROJECTILE

(75) Inventors: Rudolf Rossmann, Buelach; Jakob Burri, Regensdorf, both of (CH)

(73) Assignee: Oerlikon Contraves AG, Zurich (CH)

( * ) Notice: Subject to any disclaimer, the term of this patent is extended or adjusted under 35 U.S.C. 154(b) by 0 days.

(21) Appl. No.: 09/406,052

(22) Filed: Sep. 27, 1999

(30) Foreign Application Priority Data

Nov. 6, 1998 (CH) ..... 2233/98

(51) Int. Cl.[7] ..... F42B 14/06
(52) U.S. Cl. ..... 102/521
(58) Field of Search ..... 102/520–523

(56) References Cited

U.S. PATENT DOCUMENTS

| | | | | |
|---|---|---|---|---|
| 3,927,618 | | 12/1975 | Engel . | |
| 4,517,899 | * | 5/1985 | Haberl | 102/521 |
| 4,535,698 | * | 8/1985 | Yuen | 102/521 |
| 4,747,191 | * | 5/1988 | Montier et al. | 102/521 |
| 4,833,995 | | 5/1989 | Gotz et al. . | |
| 5,404,816 | | 4/1995 | Burri . | |
| 5,789,699 | * | 8/1998 | Stewart et al. | 102/521 |

FOREIGN PATENT DOCUMENTS

| | | |
|---|---|---|
| 0 300 373 A2 | 1/1989 | (EP) . |
| 0 624 774 A1 | 11/1994 | (EP) . |
| 0 643 279 A1 | 3/1995 | (EP) . |
| 0 853 228 A1 | 7/1998 | (EP) . |
| 0 855 573 A1 | 7/1998 | (EP) . |

* cited by examiner

*Primary Examiner*—Harold J. Tudor
(74) *Attorney, Agent, or Firm*—Townsend and Townsend and Crew LLP; Guy W. Chambers

(57) ABSTRACT

Anchoring of a spin-stabilized projectile with a sabot body is provided by grooves arranged on the fin-stabilized projectile, which are engaged by ring-shaped protrusions provided in an axial bore of the sabot body. The distance of the first protrusion from the predetermined breaking points of the sabot body and the height of the protrusions are selected in such a way that the deformation at the predetermined breaking points in case of assembly-related spreading of the segment lies in the resilient range.

15 Claims, 3 Drawing Sheets

CARTRIDGE-CASE BASE FOR A SUB-CALIBER PROJECTILE

FIELD OF THE INVENTION

The invention relates to a sabot for a sub-caliber projectile in the form of a fin-stabilized projectile, having a sabot body in which the fin-stabilized projectile is anchored, and a sabot shell, which partially surrounds the front and rear end of the fin-stabilized projectile and at least partially the sabot body, wherein the sabot body is partitioned into segments by slits, and wherein the slits are limited by predetermined breaking points at one end of the sabot body.

BACKGROUND OF THE INVENTION

Problems often occur in connection with such sabots, which lie in the difficulty of providing sealing of the sabot and the sub-caliber projectile, or respectively fin-stabilized projectile, against the high-pressure propulsive gases being generated upon firing.

A sabot in accordance with the preamble is known from EP-A-0 624 774, wherein the, sabot body has an area which is not enclosed by the sabot shell and has a circumferential groove for fastening a shroud. To overcome the above mentioned sealing problems, longitudinal slits and predetermined breaking points are provided in the sabot body, wherein the predetermined breaking points are provided in the area of the interior diameter at the acceleration portion of the sabot body. In the area of the circumferential groove, the longitudinal slits have a T-shaped cross section with two shoulders, which are used as additional sealing faces for the material of the sabot shell located in the longitudinal slits. The acceleration portion of the sabot body is designed to be partially in the shape of a truncated cone with a shell surface widening toward the front. The sabot shell furthermore has a sealing cap, which is designed to work together with the acceleration portion of the sabot body, and a seal.

Further improvements regarding sealing, weight reduction and fragment formation during firing, as well as a simplified structure, are achieved with a further development of the above described sabot known from EP-A-0 855 573. In this case, the sabot body is completely surrounded by the sabot shell, wherein the sabot shell also partially encloses the rear end of the fin-stabilized projectile. The sabot body has the shape of a hollow cylinder provided with circumferential grooves, whose exterior diameter is small in comparison with the diameter of the sabot shell.

With the above described sabots, the fin-stabilized projectile is anchored in the form of a screw connection, wherein the threads of the screw connection must be considered a weak point in regard to sealing.

OBJECT AND SUMMARY OF THE INVENTION

It is therefore an object of the invention to propose a sabot of the type mentioned at the outset which does not have this disadvantage.

This object is attained by the invention recited in the claims. Here, the anchoring is constituted by grooves arranged on the fin-stabilized projectile, which are engaged by ring-shaped protrusions provided in an axial bore of the sabot body. The distance of the first protrusion from the pre-determined breaking points and the height of the protrusions are selected to be such that the deformation at the predetermined breaking points in case of an assembly-related spreading lies within a resilient range. The advantages which are obtained by the invention can be seen in that sealing is further improved by means of the proposed anchoring. The design of the sabot body proposed by the first embodiment in the form of a double truncated cone makes possible an improved effect of the propulsive gases during firing in comparison with the last-mentioned prior art, and a weight saving in comparison with the first-mentioned prior art.

The invention will be explained in greater detail in what follows by means of two exemplary embodiment in connection with the drawings.

DETAILED DESCRIPTION OF THE PREFERRED EMBODIMENTS

Figure 5:
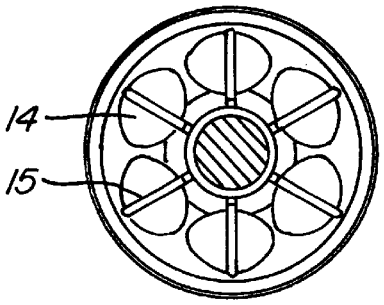
FIG. 5 is a plan view of the sabot in the direction of the arrow C in FIG. 3.
Figure 3:
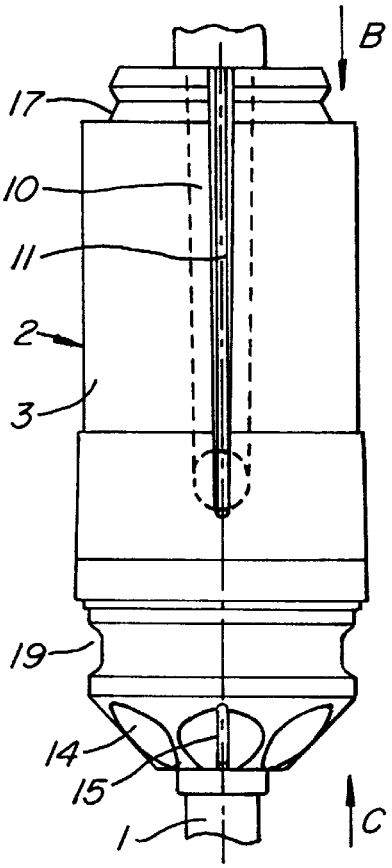
FIG. 3 is a plan view of the sabot in the direction of the arrow A in FIG. 1.
Figure 1:
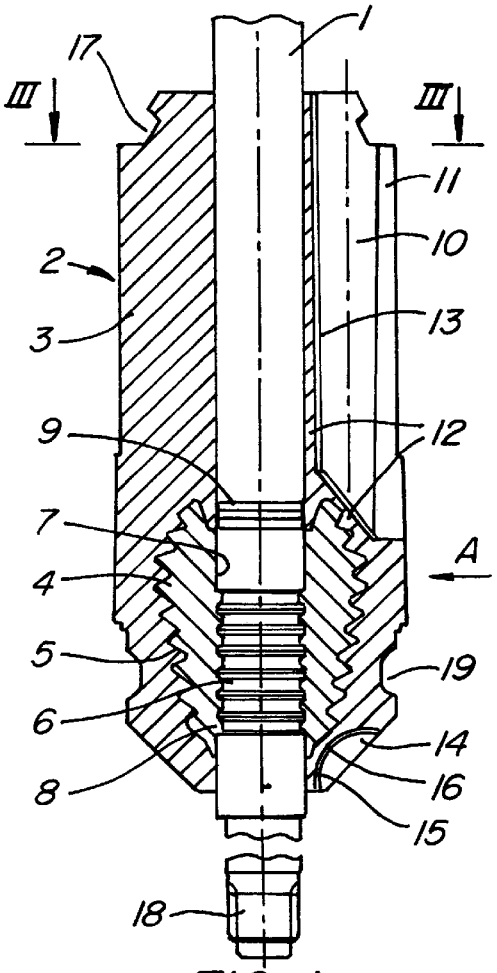
FIG. 1 is a longitudinal sectional view along the line I—I in FIG. 4 through the sabot in accordance with the invention with a fin-stabilized projectile in a first embodiment.
Figure 4:
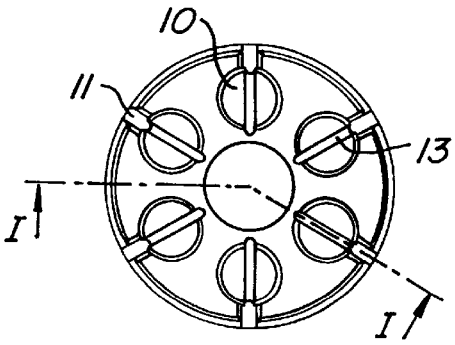
FIG. 4 is a plan view of the sabot in the direction of the arrow B in FIG. 3.
Figure 2:
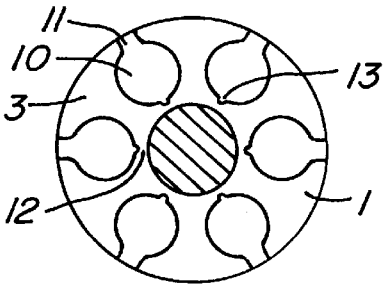
FIG. 2 is a cross section through the sabot along the line III—III in FIG. 1.

In FIGS. 1 to 5, a fin-stabilized projectile is identified by 1, and by 2 a sabot arranged on the fin-stabilized projectile 1. The sabot 2 consists of a sabot shell 3 made of a highly heat-resistant, filler-reinforced thermoplastic material and a sabot body 4 made of a light metal. The sabot body 4 is completely surrounded by the sabot shell 3, wherein the sabot shell 3 engages grooves 5 of the sabot body 4 and surrounds a portion of the front and rear end of the fin-stabilized projectile 1. The fin-stabilized projectile 1 has grooves 6, which are engaged by ring- shaped protrusions 8 provided in an axial bore 7 of the sabot body 4. The grooves 6 and the ring-shaped protrusions 8 have the same trapezoidal cross section and engage each other in the manner of a denticulation almost free of play. Further grooves 9 are provided in the fin-stabilized projectile 1 in the area of the front end of the sabot body 4, by means of which additional sealing is achieved.

In the front part of the sabot shell 3 six conduits 10 are provided, which are evenly distributed on the circumference and taper conically toward the rear, and are connected with slits 11, which are also conically tapered toward the rear, in the surface of the sabot shell 3. Six segments and six predetermined breaking points 12 are formed by the six conduits 10 and slits 11, which are locally predetermined by means of furrows 13 arranged in the conduits 10. Six depressions 14 in the shape of a segment of a sphere and having further furrows 15 are provided in the rear portion of the sabot shell 3 and form further predetermined breaking points 16.

In a manner not further represented and described, the front end of the fin-stabilized projectile 1 can be covered by a shroud fastened on the sabot shell 3, for which purpose a circumferential groove 17 is provided. A threaded section 18 is arranged on the rear portion of the fin-stabilized projectile 1, by means of which a stabilizing fin, also not represented, can be fastened. A circumferential groove for fixing a cartridge case is identified by 19.

Figure 6:
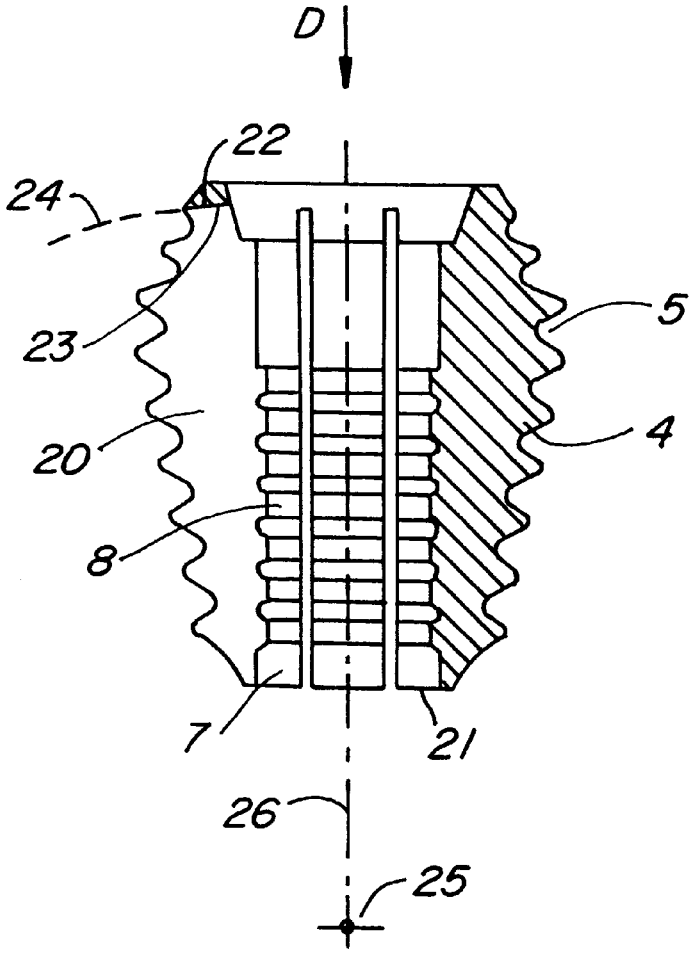
FIG. 6 is a longitudinal sectional view through a sabot body along the line VI—VI in FIG. 7 on an enlarged scale.
Figure 7:
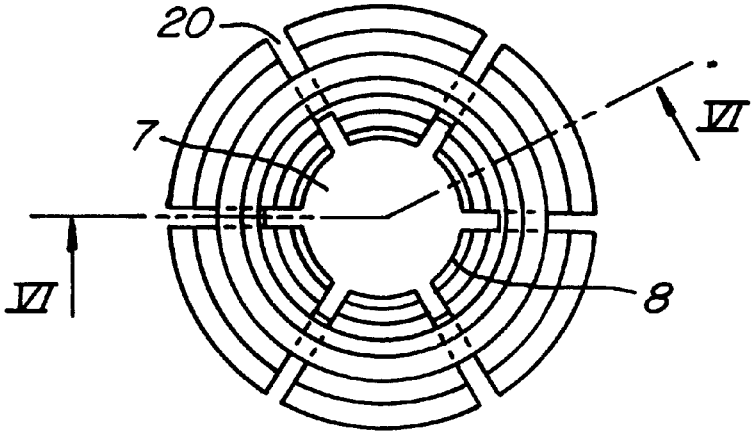
FIG. 7 is a plan view of the sabot in the direction of the arrow D in FIG. 6.
Figure 10:
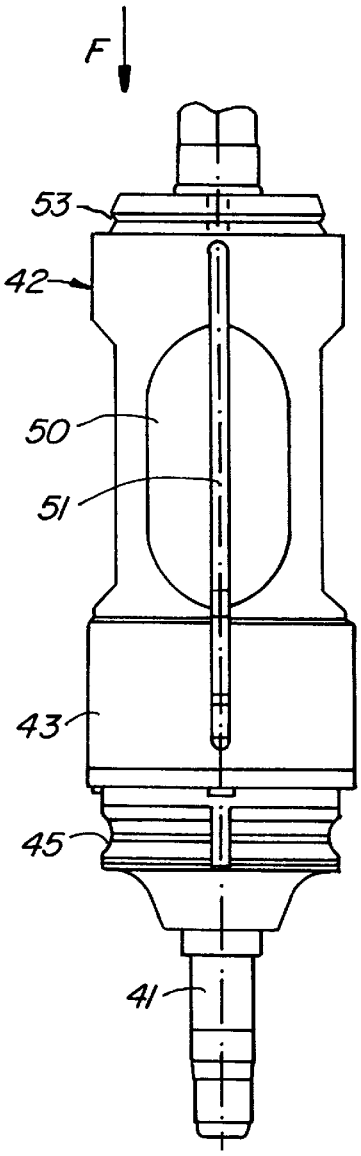
FIG. 10 is a plan view of the sabot in the direction of the arrow E in FIG. 8.
Figure 8:
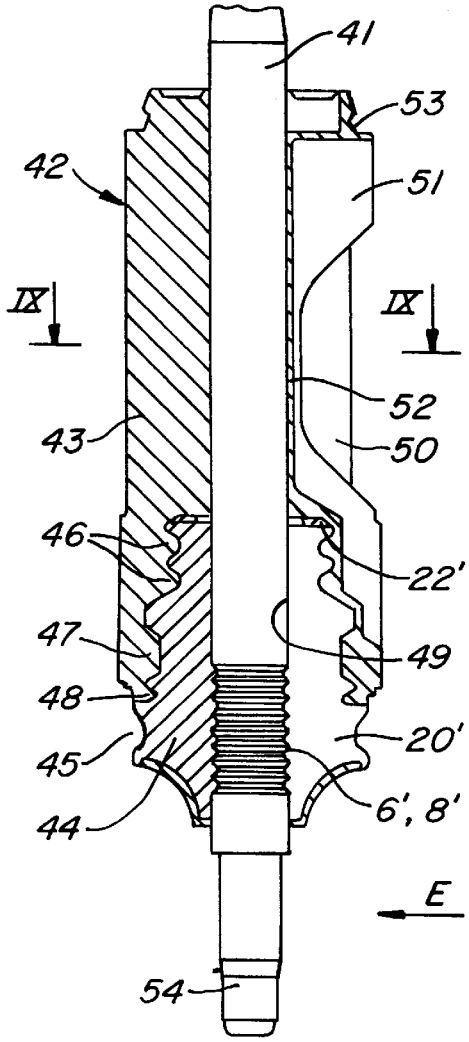
FIG. 8 is a longitudinal sectional view along the line VIII—VIII in FIG. 9 through the sabot with a fin-stabilized projectile in a second embodiment.
Figure 11:
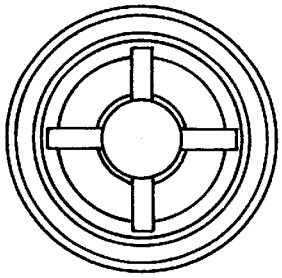
FIG. 11 is a plan view of the sabot in the direction of the arrow F in FIG. 10.
Figure 9:
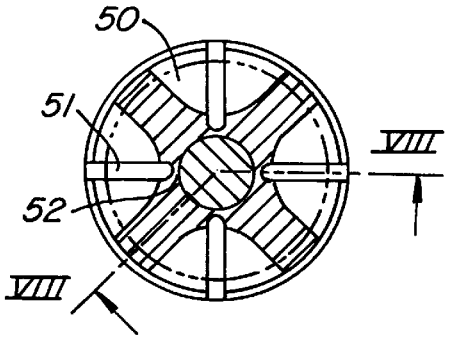
FIG. 9 is a cross section through the sabot along the line IX—IX in FIG. 8.

In accordance with FIGS. 6 and 7, the sabot body 4 is composed of two truncated cones of uneven length with a common-sized diameter. Six slits 20, which are evenly distributed over the circumference and constitute six segments, are provided in the sabot body 4 and extend from the rear face 21 to the front end of the sabot body 4, where they are limited by predetermined breaking points 22. The limiting faces 23 of the predetermined breaking points 22 are located on an arc of a circle 24, whose center of curvature 25 is located on the center axis 26 of the sabot shell 4. The predetermined breaking points 22 are located in the area of the smaller diameter of the shorter truncated cone, wherein the shorter truncated cone is oriented toward the front end of the fin-stabilized projectile 1. The distance of the predetermined breaking points 22 from the first ring-shaped protrusion 8 and the height of the protrusions 8 have been selected such that the deformation at the predetermined breaking points 22 in the course of assembly-related spreading of the segments lies in the resilient range.

In FIGS. 8 to 11, a fin-stabilized projectile is identified by 41, and by 42 a sabot arranged on the fin-stabilized projectile 41. The sabot 42 consists of a sabot shell 43 made of a highly heat-resistant, filler-reinforced thermoplastic material and a sabot body 44 made of a light metal. The sabot shell 43 surrounds the sabot body 44 with the exception of an area, in which a circumferential groove 45 for fastening cartridge case is provided, and engages cicumferential grooves 46, 47, 48 of the sabot body 44. Moreover, the sabot shell 43 surrounds a larger portion of the front end and a smaller portion of the rear of the fin-stabilized projectile 41. Similar to the way described above by means of FIGS. 1 to 5, the fin-stabilized projectile 41 has grooves 6', which are engaged by protrusions 8' provided in an axial bore 49 of the sabot body 44. Similar to the way described by means of FIGS. 6 and 7, slits 20' and predetermined breaking points 22' are provided on the sabot body 44, wherein the end of the sabot body 44 provided with the predetermined breaking points 22' is oriented toward the front end of the fin-stabilized projectile 41.

Four recesses 50, evenly distributed on the circumference and having an approximately V-shaped cross section, and four grooves 51, extending in the longitudinal direction in axes of symmetry of the recesses 50, by means of which predetermined breaking points 52 of the sabot shell 43 are locally predetermined, are provided in the front part of the sabot shell 43. A circumferential groove, which is used for fastening a shroud, not represented, is identified by 53. A threaded element 54 is provided on the back end of the fin-stabilized projectile 41, by means of which a stabilizing fin, also not represented, can be fastened.

It is also possible to embody the sabot shell 3 and/or the sabot body 4 of the first embodiment with three, four or five conduits 10 and slits 11, or respectively slits 20, so that costs are saved. On the other hand, the embodiment with six conduits 10 and slits 11, or respectively 20, has less mass and results in fewer separation interferences following firing. It is also within the scope of the invention to select a different number and distribution of the recesses 50 and grooves 51, or respectively slits 20', at the circumference of the sabot shell 43 and sabot body 44 of the second embodiment.

In place of a light metal, the sabot body 4 of the first embodiment can also consist of a highly heat-resistant, filler-reinforced thermoplastic, in particular fiber-reinforced, material.

What is claimed is:

1. A sub-caliber projectile with sabot, in the form of a fin-stabilized projectile, comprising a sabot body in which the fin-stabilized projectile is anchored, a sabot shell, which partially surrounds the front and rear end of the fin-stabilized projectile and at least partially the sabot body, wherein the sabot body is partitioned into segments by slits, and wherein the slits are limited by predetermined breaking points at one end of the sabot body, wherein the anchoring is constituted by grooves arranged on the fin-stabilized projectile, which are engaged by ring-shaped protrusions provided in an axial bore of the sabot body, wherein the distance of a first of said protrusions from the predetermined breaking points and the height of said protrusions are selected in such a way that deformation at the predetermined breaking points in case of assembly-related spreading of the segments lies in the resilient range.

2. The sub-caliber projectile with sabot in accordance with claim 1, wherein the grooves arranged on the fin-stabilized projectile have a first trapezoidal cross section and the ring-shaped protrusions provided in the axial bore of the sabot body have a second trapezoidal cross section and engage each other almost free of play wherein the first trapezoidal cross section and the second trapezoidal cross section are the same.

3. The sub-caliber projectile with sabot in accordance with claim 1, wherein the sabot body is completely surrounded by the sabot shell, wherein the sabot body is composed of two truncated cones having the same size larger cone diameter, wherein one of the two truncated cones is shorter than the other truncated cone, and the predetermined breaking points are arranged in the area of the smaller cone diameter on the shorter truncated cone.

4. The sub-caliber projectile with sabot in accordance with claim 3, wherein the shorter truncated cone of the sabot body having the predetermined breaking points is orientated toward the front end of the fin-stabilized projectile.

5. The sub-caliber projectile with sabot in accordance with claim 3, further comprising a number of conduits in a front portion of the sabot shell which are evenly distributed over the circumference and conically taper toward the rear, and connected with a surface of the sabot shell via slits, which taper conically toward the rear.

6. The sub-caliber projectile with sabot in accordance with claim 5, wherein six conduits and slits are provided in the sabot shell.

7. The sub-caliber projectile with sabot in accordance with claim 5, wherein four conduits and slits are provided in the sabot shell.

8. The sub-caliber projectile with sabot in accordance with claim 3, wherein six slits are provided in the sabot body.

9. The sub-caliber projectile with sabot in accordance with claim 3, wherein four slits are provided in the sabot body.

10. The sub-caliber projectile with sabot in accordance with claim 3, wherein further grooves are provided in the fin-stabilized projectile in the area of a front end of the sabot body.

11. The sub-caliber projectile with sabot in accordance with claim 3, wherein the sabot body consists of a highly heat-resistant, filler-reinforced thermoplastic material.

12. The sub-caliber projectile with sabot in accordance with claim 1, wherein the sabot body has an area not surrounded by the sabot shell, which has a circumferential groove for fastening a cartridge case, and the sabot body is arranged on the fin-stabilized projectile in such a way that an end of the sabot body with the predetermined breaking points is oriented toward a front end of the fin-stabilized projectile.

13. The sub-caliber projectile with sabot in accordance with claim 12, wherein four recesses, which are evenly distributed at the sabot shell circumference, and four grooves extending in the longitudinal direction, are provided in a front portion of the sabot shell.

14. The sub-caliber projectile with sabot in accordance with claim 13, wherein the recesses have an approximately V-shaped cross section.

15. The sub-caliber projectile with sabot in accordance with claim 13, wherein the grooves are arranged to extend in axes of symmetry of the recesses.

* * * * *